United States Patent [19]

Belopavlovich et al.

[11] 4,235,500

[45] Nov. 25, 1980

[54] CIRCUIT CONNECTOR

[75] Inventors: Peter Belopavlovich; Leonard H. Michaels; Richard Zic, all of Chicago, Ill.

[73] Assignee: TRW Inc., Elk Grove Village, Ill.

[21] Appl. No.: 958,611

[22] Filed: Nov. 8, 1978

[51] Int. Cl.[3] ..... H01R 13/514

[52] U.S. Cl. ..... 339/176 MF

[58] Field of Search ..... 339/128, 176 MF, 176 MP, 339/17 F, 17 CF, 128, 174

[56] References Cited

U.S. PATENT DOCUMENTS

| | | | |
|---|---|---|---|
| 3,090,028 | 5/1963 | Hall et al. | 339/174 |
| 3,226,668 | 12/1965 | Baer | 339/176 MF X |
| 3,307,139 | 2/1967 | Prise | 339/176 |
| 3,701,071 | 10/1972 | Landman | 339/176 MP X |
| 3,744,005 | 7/1973 | Sitzler | 339/176 MP X |
| 3,873,173 | 3/1975 | Anhalt | 339/17 CF |
| 3,989,336 | 11/1976 | Rizzio, Jr. et al. | 339/17 FX |
| 4,130,327 | 12/1978 | Spaulding | 339/17 CF |

*Primary Examiner*—Roy Lake

*Assistant Examiner*—John S. Brown

*Attorney, Agent, or Firm*—Neuman, Williams, Anderson & Olson

[57] ABSTRACT

A circuit connector for electrically connecting a substantially flat flexible conductor to a second conductor. The connector generally includes a housing, a cover, and contacts. The housing is of insulating material and has a relatively flat conductor receiving surface and a plurality of openings that communicate with the conductor receiving surface. A generally resilient self-locking domed wiping contact is disposed in the housing beneath each opening, and slidably engages retaining grooves of the housing. At least one portion of each contact protrudes above the conductor receiving surface to make electrical contact with the flat conductor, and a second portion is adapted for connection to a second conductor. The cover is superposed the flat conductor receiving surface for receiving the flat conductor therebetween. The cover is movable to press and releasably retain the flexible circuit in electrical connection with said resilient contacts.

18 Claims, 10 Drawing Figures

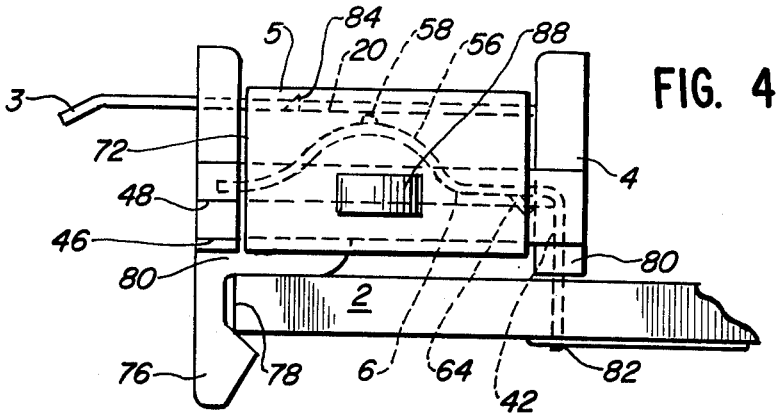
FIG. 4
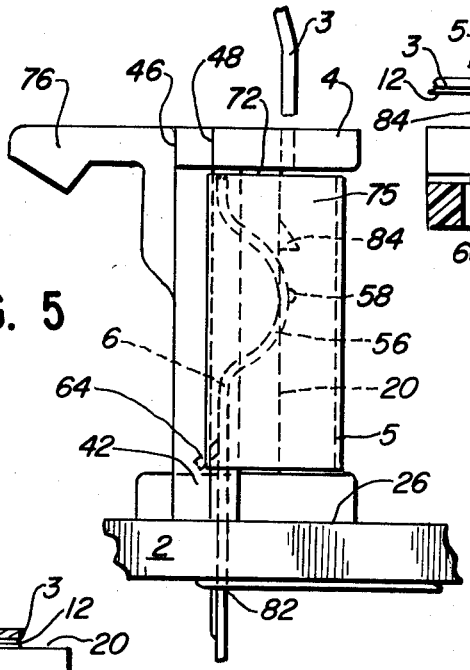
FIG. 5
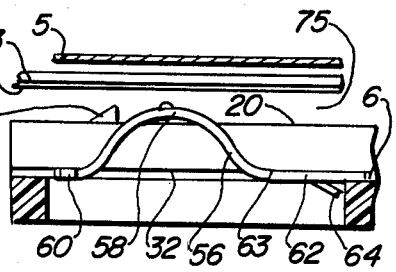
FIG. 5A
FIG. 4A
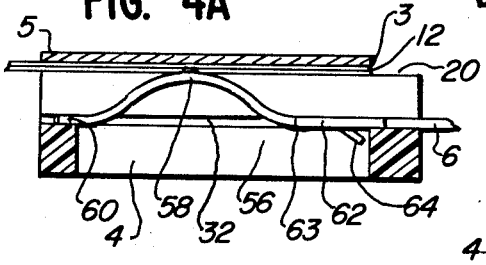
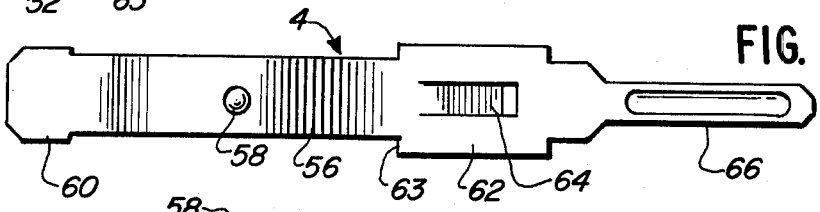
FIG. 6
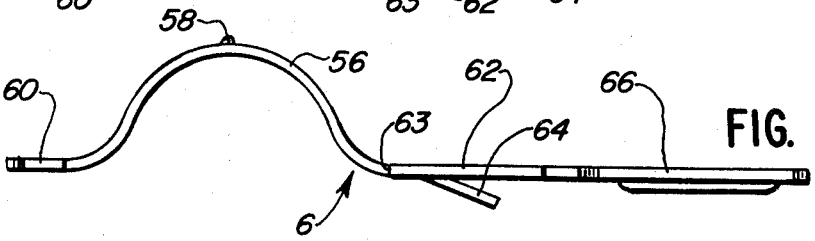
FIG. 7

CIRCUIT CONNECTOR

BACKGROUND OF THE INVENTION

1. Field Of The Invention

The present invention relates to electrical connectors, and more particularly to connectors for terminating or otherwise making electrical contact with thin, flat, flexible conductor circuit elements, commonly referred to as a "flex circuit" and having a plurality of ribbons of conductive material. Such a connector should provide reliable electrical contact and sufficient mechanical support or strain relief to further insure circuit continuity. This connector typically interfaces a flat flexible conductor with a printed circuit or other circuit board, but is equally suitable for connection with another flexible circuit or wires. Preferably, such a connector should have a zero insertion force to avoid damage to the thin flexible circuit, such as scratching, scarring, or galling.

2. Brief Description Of The Prior Art

Flexible circuits and flat multi-conductors are well known in the art and are commonly used because of their reliability, flexibility, compactness, and ability to satisfy unusual space restrictions.

In the past, flexible circuits have been connected to other circuit elements by, among other methods, soldering. This has the disadvantages of being costly in time and equipment, and requiring special tools and materials such as soldering irons, flux, solder, and cleaning solutions. This method requires considerable caution and skill to avoid improper or "cold" connections and runs a substantial risk of heat damage to the flexible circuit and other circuit elements. Disconnection is often messy, self-defeating, and runs the same risks, in addition to being equally costly.

Other methods of connection include bonding, crimping, pressure contact, and welding. While the first three may not result in heat damage, physical damage may result from the required deformation of the circuit elements or conductors, and the reliability is often unacceptably low. Welding requires specially designed equipment, skilled personnel, and significant amounts of heat, thereby suffering from many of the disadvantages of soldering.

Known pressure connectors suffer a host of disadvantages or disabilities. U.S. Pat. No. 3,090,028, issued to Hall et al., discloses a pressure connector requiring close manufacturing tolerances for a proper fit between successive partition and presser members. It is necessary to undertake an exact and complex partial stripping of the cable insulation for proper contact, and then slit the conductor substrate between each connector for depression into the contact wells when the cover is closed. This likely requires special tools and training, and may result in damaged or misaligned conductors. Further, once the conductor is slit and stripped, it will not be compatible with other connectors. Another connector requiring close manufacturing tolerances and complex molds is U.S. Pat. No. 3,989,336, issued to Rizzio et al., which discloses a pressure connector requiring intricate and pre-loaded contact loops. Strain relief is provided for the movable cover, which suffers from plastic cold-flow deformation problems, and an upward pull on the conductor may disengage the cover and open the connector. Other strain relief is provided, but it requires delicate threading around sharp corners which may break the narrow conductive strips. The design requires that the housing define an opening into which the conductor must be inserted. There is no visual indication of when the conductor is properly seated and the connector may only be mounted on one side. Use is further complicated and practically restricted to circuit boards because the connecting end of the contacts and the flex circuit are disposed on the same side of the connector, it is difficult to maintain electrical isolation. Said conductor, as well as the one disclosed by Hall et al., also lacks provisions for through connection.

Still other pressure connectors, such as that disclosed in U.S. Pat. No. 3,307,139, issued to Prise, are "sandwich" connectors for connecting two flex cables. Such are not compatible for connection with circuit boards or other conductors.

A more recent method is to use an edge connector similar to those for connecting rigid circuit boards or elements. Although these have been successful with rigid connectors, they require the application of an insertion force, which is often incompatible with or may result in irreparable damage to a flexible circuit.

SUMMARY OF THE INVENTION

It is an object of the present invention to provide an improved circuit connector for electrically connecting a substantially flat, flexible circuit component to a second circuit element.

It is a further object to provide a circuit connector where a substantially flat, flexible circuit element may be electrically connected or disconnected by inserting or removing said flexible circuit element with an insignificant or near zero force.

It is still a further object to provide an improved circuit connector for electrically connecting a substantially flat, flexible circuit element to a second circuit element and for providing mechanical support and strain relief.

It is still a further object to provide an improved circuit connector for electrically connecting a flat, flexible circuit element utilizing contacts of simple configuration which may be interchanged as desired.

It is still a further object to provide such a circuit connector which may be simply and reliably mounted on rigid circuit boards of varying thicknesses with a minimum of operations and be compatible with conventional circuit manufacturing techniques.

It is still a further object to provide a circuit connector for a substantially flat, flexible circuit element which may be easily manufactured, used with a minimum of training, is compact, and is characterized by electrical and mechanical reliability over a long life.

These and other objects are accomplished by a circuit connector for electrically connecting a substantially flat first conductor element to a second conductor element, including a housing of insulating material, a plurality of unitary contact means for mounting in said housing, and a movable cover. The housing includes a first conductor receiving surface and a plurality of contact receiving openings. A plurality of unitary contacts are adapted for mounting in said openings, and each includes a resilient depressable portion normally protruding above the conductor surface and a terminal portion for connection with a second conductor. A cover is superposed the first conductor receiving surface for receiving said first conductor therebetween. The cover may be secured to the housing to press said first conductor against the contacts to establish electrical connection therewith.

BRIEF DESCRIPTION OF THE DRAWINGS

FIG. 4 is a side view of the circuit connector assembly mounted generally parallel to a circuit board. A flexible conductor is pressed against the contacts, both shown in phantom lines, by a cover.

FIG. 4A is a sectional view taken along lines 4A—4A of FIG. 3 showing the cover pressing the flexible circuit into electrical connection with the resilient contacts.

FIG. 5 is a side view of the circuit connector housing mounted generally perpendicular to a circuit board with the cover in its raised position and with no flexible conductor in the connector.

FIG. 5A is a sectional view taken along lines 5A—5A of FIG. 3 showing the cover superposed the conductor receiving surface for receiving a flat conductor therebetween.

FIG. 6 is an enlarged top plan view of a contact for use in a connector housing.

FIG. 7 is a side plan view of the contact of FIG. 6.

DETAILED DESCRIPTION OF THE DRAWINGS AND A PREFERRED EMBODIMENT

Figure 1:
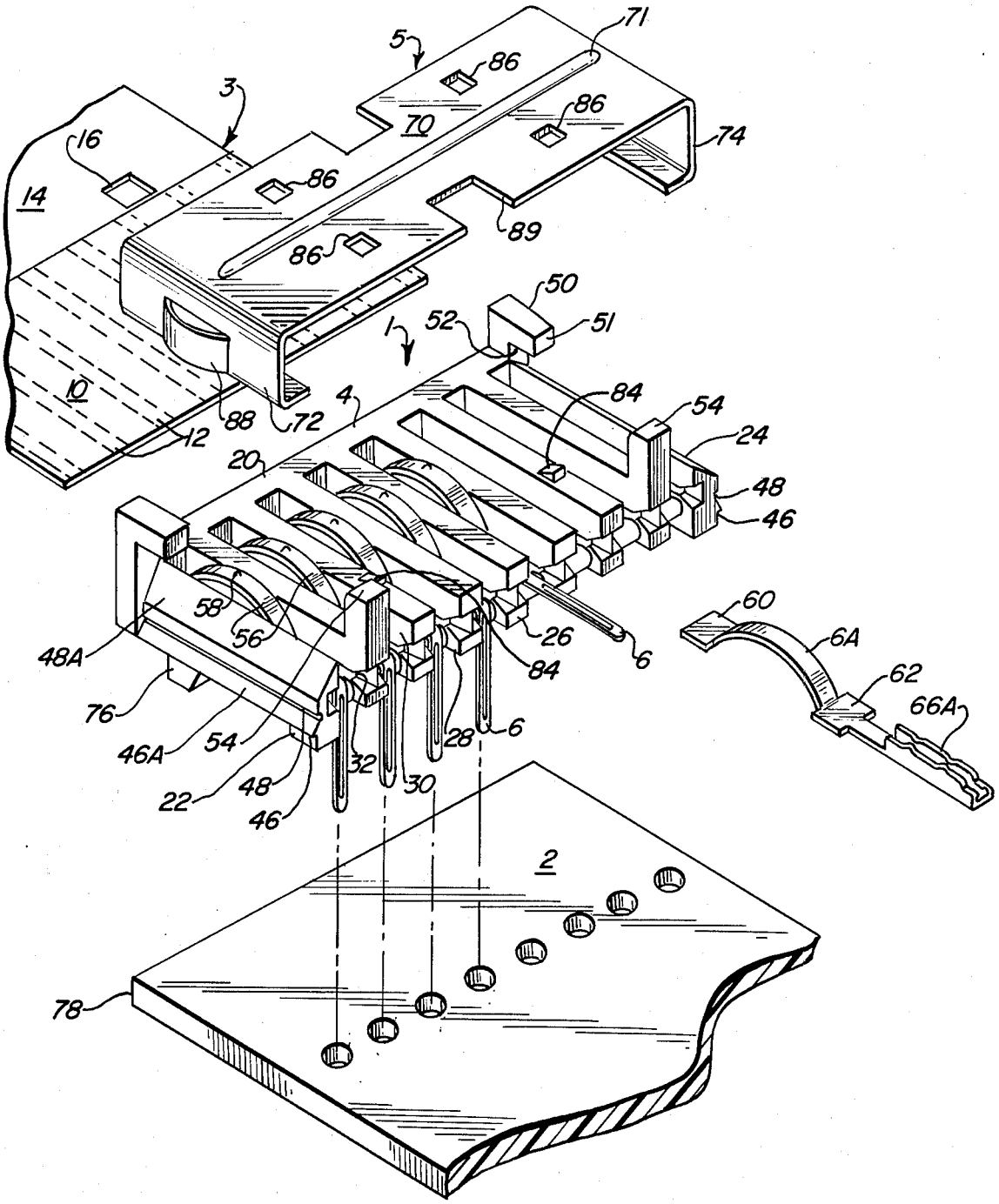
FIG. 1 is a perspective partially exploded view of one form of a circuit connector assembly employing teachings of this invention, and including a housing, cover, and contacts, adapted for mounting on a circuit board and for connection with a substantially flat thin flexible conductor.

Referring now to FIG. 1, a circuit connector 1 is shown above a circuit board or other substrate 2 and adjacent a substantially flat conductor element 3. The connector 1 generally includes a housing 4, a cover 5, and a plurality of contacts 6.

The conductor element 3 is commonly known in the art as a "flex circuit" and usually comprises a flexible insulating substrate or film 10 having narrow ribbons of electrically conductive material 12, such as a metal film or other conductive material, attached thereto. A second insulating substrate or film 14 may cover the electrically conductive material 12. Cut-outs 16 may be placed as convenient for strain relief. Such a conductor is typically 0.006 to 0.015 inches thick.

Figure 2:
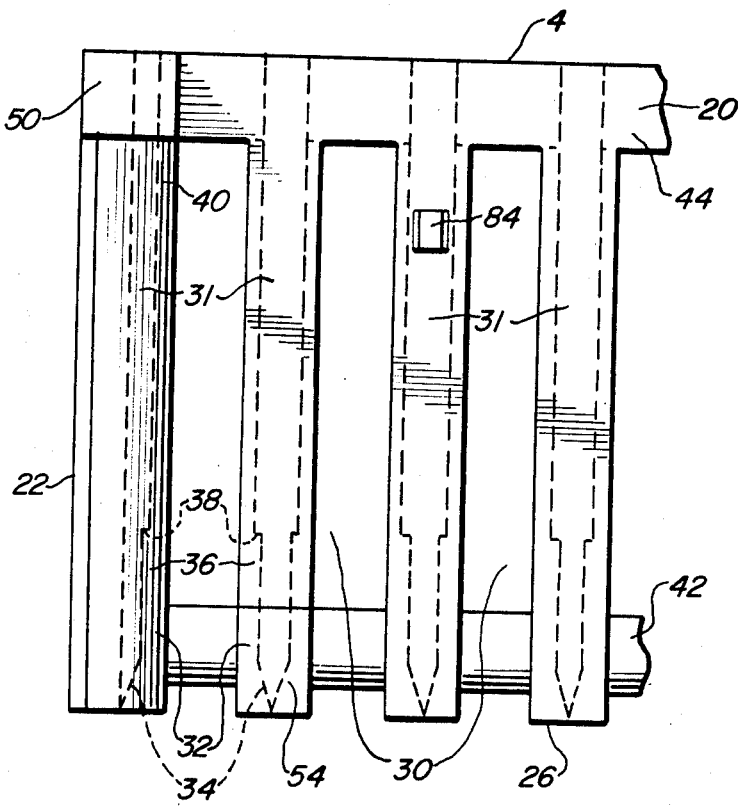
FIG. 2 is an enlarged partial top plan view of the conductor receiving surface of the circuit connector housing, with the contact retaining recesses shown in phantom lines.
Figure 3:
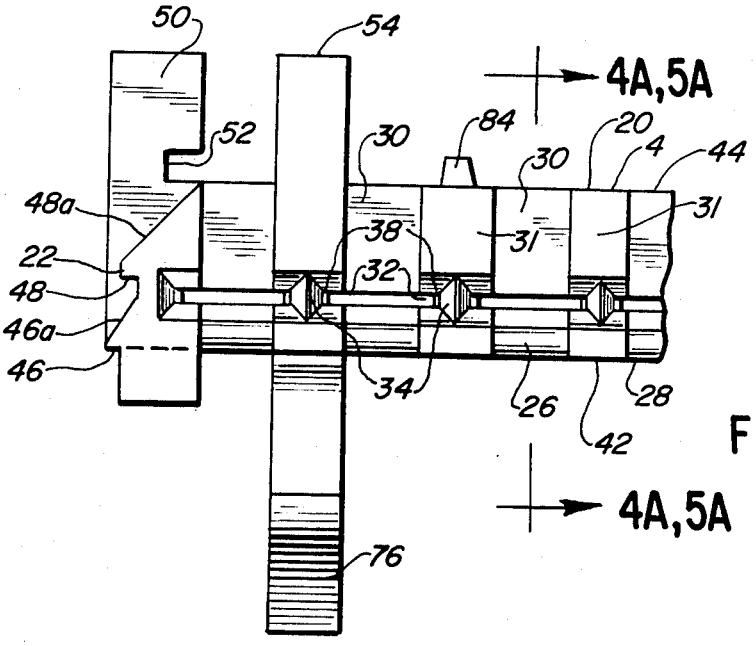
FIG. 3 is a front end view of the circuit connector housing segment of FIG. 2.

Referring also to FIGS. 2 and 3, the connector housing 4 is generally rectangular in shape with a first conductor receiving surface 20, cover retaining sides 22 and 24, a contact insertion end 26, and a base portion 28. The housing 4 is made of an insulating material, such as polyester and may assume any convenient shape, but it is desirable that the first conductor receiving surface 20 be relatively flat, or otherwise conform to the desired configuration of said conductor 3.

The housing 4 is formed with a plurality of contact receiving openings, channels or recesses 30 communicating with the conductor receiving surface 20, forming a plurality of insulating ribs or barriers 31 separating each channel. The channels 30 are slightly wider than the bowed contacting portion of the contacts 6, which will be described in detail later.

Each channel 30 includes corresponding sets of opposed contact retaining recesses or slots 32 extending laterally along the length of the main channel for receiving and supporting the individual contacts 6. The slots 32 are at a depth from the conductor receiving surface 20 such that the bowed portion of the contact partially protrudes above the conductor receiving surface 20 when the wider flange sections 60 and 62 of the contacts are engaged in the slots 32. The entrance end 34 to each of said slots 32 is preferably tapered as seen in FIGS. 2 and 3 to provide for ease of insertion of the contacts 6. Advancing along the slot 32 from the entrance end 34, the slot narrows transversely to form a shoulder 38 which abuts a first set of flanges 62 of the contact to help position the contact. Said contact retaining slots 32 continue at a reduced width over the remaining length of the channels 30 to the end 40 to moveably support another set of narrower flanges 60 of said contact.

Ramps or posts 84 may be positioned on the housing fingers 31 to engage the strain relief cut-outs 16 of the conductor 3 and help prevent inadvertent removal of the conductor.

First and second support ribs 42 and 44, respectively, are an integral portion of said housing 4 and extend the length thereof, traversing the contact channels 30 near their ends and connecting the insulating fingers 31 of the housing 4.

The cover retaining sides 22 and 24 include first and second locking ridges 48 and 46, respectively, on each end that extend substantially the width of the housing. Tapered entrance ramp surfaces 46a and 48a are provided on the upper side of each of these ridges, being tapered from the base 28 towards the conductor receiving surface 20 to facilitate snap engagement of the cover with the shoulders defined by the undersides of the ridges 46 and 48. These ridges cooperate with the cover to releasably retain the cover when it is pressed into engagement with the conductor and against the housing, thereby pressing the conductor into electrical contact with the contacts 6.

A set of guide posts 50 on each side of the housing 4 extend upwardly from the conductor receiving surface 20 and guide the conductor onto said surface 20 to prevent lateral movement thereof. An angled protrusion 51 atop each guide post is superposed the conductor receiving surface and cover to prevent inadvertent removal of the cover during unlatching. A set of stop posts 54 at the forward end of the housing 4 extend upwardly from the conductor receiving surface 20 to form insertion stops and prevent longitudinal movement of said conductor 3. Both posts may include a slot 52 as shown in guide post 50 to accept the flexible conductor 3. Said guides also help position the cover 5.

Referring now to FIGS. 6 and 7, each contact 6 is of a simple bowed configuration being formed of a resilient conductive material, preferably being made of brass and gold plated. Each contact includes a first resilient bowed contacting portion 56 having a raised dimple 58 at the apex. A first set of flanges 60 on the first end are designed to slide freely in end 40 of recess 32. A second set of flanges 62 near the middle of the contact is wider than the first set 60 and have leading edges or shoulders 63 for abutting against the shoulder 38 in the recess 32.

A locking tang 64 depends from the contact 4. The tang 64 is adapted to snap over the support rib 42 and thereafter to bear against the rear surface of the rib to retain the contact in the housing once the contact 4 has been fully inserted into the channel 30 with the stop flanges 62 abutting the shoulders 38. See also FIGS. 4, 4A and 5, 5A. A terminal portion 66 of said contact 4 extends from the channel 30 at the contact insertion side 26 for connection to a circuit board, wire, circuit element, or the like, and may be suitable for crimping, soldering, wire wrapping, solderless connection, mass termination, connection to another connector, or any combination of these as desired.

Contact 6A of FIG. 1 is an example of a solderless type terminal, for instance as disclosed in U.S. Pat. No. 4,040,702, compatible with this improved connector. If additional support is required for the terminal portion 66A of the contact 6A, the housing 4 may be extended as necessary to provide bottom and lateral support for the terminal end. An additional cover may also be placed over the extended housing to provide protection and strain relief for these terminals and the terminated conductors.

The bowed portion 56 of each contact is inserted into the channel 30 as guided by the tapered entrance portion 34. As the leading edge 63 of the second set of flanges 62 approaches the shoulder 36, the locking tang 64 is compressed toward the body of the contact 4 by the rib 42. When the contact is fully inserted, tang 64 extends to its non-compressed position behind the rib 42, preventing inadvertent removal. The bowed portion 56 and the dimple 58 protrude above the conductor receiving surface 20 to make contact with the flexible conductor 3. As shown in FIGS. 4, 4A, and 5, 5A, the first set of flanges 60 for each contact slide freely in the end 40 of the recesses 32 to accomodate the resilient movement of the contacts as the bows are compressed. Additional versatility in the use of this connector comes from the ability to separately insert or remove different types of contacts.

A cover 5 is generally C-shaped with a top 70 and depending leg portions 72 and 74 which respectively compressibly engage cover retaining sides 22 and 24. The cover may be made of spring steel or an insulating material such as plastic and may have a rib 71 to minimize flexing. Once the contacts 6 are inserted, the cover is pressed onto the housing 4 to its first position superposed the conductor receiving surface 20 with the legs 72 and 74, respectively, each engaging beneath the first tapered ridges 48. In this position as shown in FIGS. 5, 5A, the cover 5 and the first conductor receiving surface 20 form a slot 75 into which the flexible conductor 3 may be inserted. The cover 5 is sufficiently spaced above the conductor receiving surface 20 so that the conductor 3 may be inserted without contacting the cover 3, contacts 6, or housing 4, thereby resulting in a zero or near zero conductor insertion and removal force. As shown in FIGS. 4 and 4A, when the cover 5 is depressed to its second position with the legs 72 and 74 engaging beneath the second tapered ridges 46, the conductor 3 is pressed by the cover into electrical contact with the contacts 6. The cover 5 may be seated by a simple squeezing or compressive manipulation of the parts, manually or with a plier-type tool. The cover may be easily removed or repositioned by inserting an appropriate tool into release loops 88 on each leg 72 of the cover and separating the legs away from the housing 4. This cover clamp is self-contained, reuseable, and will not deteriorate with age. The tapered ledges also provide a positive, audible, snap-open, snap-closed connection.

The assembled connector 1 may be mounted on a printed circuit board 2 as shown in FIGS. 1, 4 and 5. When the connector 1 is mounted parallel to the printed circuit board, a set of locking lugs or hooks 76 depending from one end of the base of the housing 28 are wrapped around an edge 78 of the printed circuit board 2 to prevent rocking or lifting, both before and after attachment or soldering. There may be any number of such hooks positioned as desired and they are tapered to accept a large range of board thicknesses. As shown in the preferred embodiment, they are located on an end opposite the terminal portion 66 of the contacts 6. The hooks may be replaced by a depending post with an enlarged compressible head for a snap-fit. The housing 4 also rests against the board 2 on feet 80.

The terminal portions 66 of the contacts 4 may be bent over the first support rib 42 to pass perpendicularly through the board 2 to be soldered beneath the board, as at 82, by conventional wave soldering techniques. The terminals may also be connected by crimping or other techniques to rigidly hold the connector in place. While these connection methods suffer from some of the disadvantages noted earlier, the conductor 3 may be easily disconnected and is effectively removed from any heat source for such mounting connectors and from deformation forces. If the connector is mounted perpendicular to the circuit board, as in FIG. 5, the housing 4 is mounted on its contact insertion side 26 and the terminal portions 66 of the contacts 4 are passed through the printed circuit board 2 and soldered or otherwise connected without being bent. As described before, the locking tang 64 prevents separation of the connector from the contacts.

The insertion and connection of the flexible conductor 3 to the connector 1 is shown in FIGS. 1, 4 and 5. The conductor ribbons 12 are exposed on the underside of the conductor 3 by removing a portion of the insulating substrate 10. The conductor 3 is inserted into the slot 75 formed by the conductor receiving surface 20 and the cover 5, with each conductor ribbon 12 overlying a bowed contact portion 56. Guide posts 50 and 54 facilitate positioning of the conductor. When the conductor 3 is fully seated, the cut-outs 16 are in register with the ramps 84 of the housing 1. These ramps 84 are also in register with the windows 86 in the cover 5 to provide a positive pin-and-hole strain relief. A cover notch 89 visually assists in positioning the conductor 3. When the conductor 3 is thus fully seated, the cover 5 is moved to its final locking position wherein legs 72 engage the second tapered ridges 46 to retain the conductor 3 in the connector 1, as shown in FIG. 4. The cover may be so seated by a simple squeezing action. The resultant compression movement forces the contact dimples 58 into electrical connection with the conducting ribbons 12, with the contacts 6 flexing as necessary to accomodate the connection movement, despite variations in dimensions. The resiliency of the contacts insures the establishment and maintaining of a reliable electrical connection. This flexing is accomodated by the first set of flanges 60 sliding in the recesses 32, and also results in a desirable slight wiping movement as pressure contact is established to assure good conductive contact of the contacts 6 and the conductive strips 12. The second set of flanges 62 is held secure against shoulders 38 by the locking tang 64. The dimple 58 also resists conductor withdrawal as well as forming a gas tight connection.

Since the flexible conductor 3 is fully inserted between the contacts 6 and the cover 5 before contact pressure is applied, there is "zero insertion force", which is highly desirable, especially for a flexible conductor. Yet good electrically conductive connections between the flex circuit and the contacts 6 are assured.

If the connector is desired for a "pass-through" or multiple connection, guides 54 may be omitted and the conductor 3 may make contact with the contacts 6 of connector 1 while passing through to still another connector.

As is apparent from this disclosure, the housing 4 is of a relatively simple construction and affords a flat open accessible surface on which the flex circuit is easily positioned. The cover is of a simple pressure snap attachment design, and the contacts are of simple unitary resilient configuration. The subject connector does not require any special tooling for installation and use. Conventional techniques and compatible and enhanced by such improvements as the locking hooks 76 and the ability to secure the connector 1 free of any disturbances from the conductor 3. The partial preassembly of the cover facilitates handling and installation and affords protection for the contacts.

Figure 8:
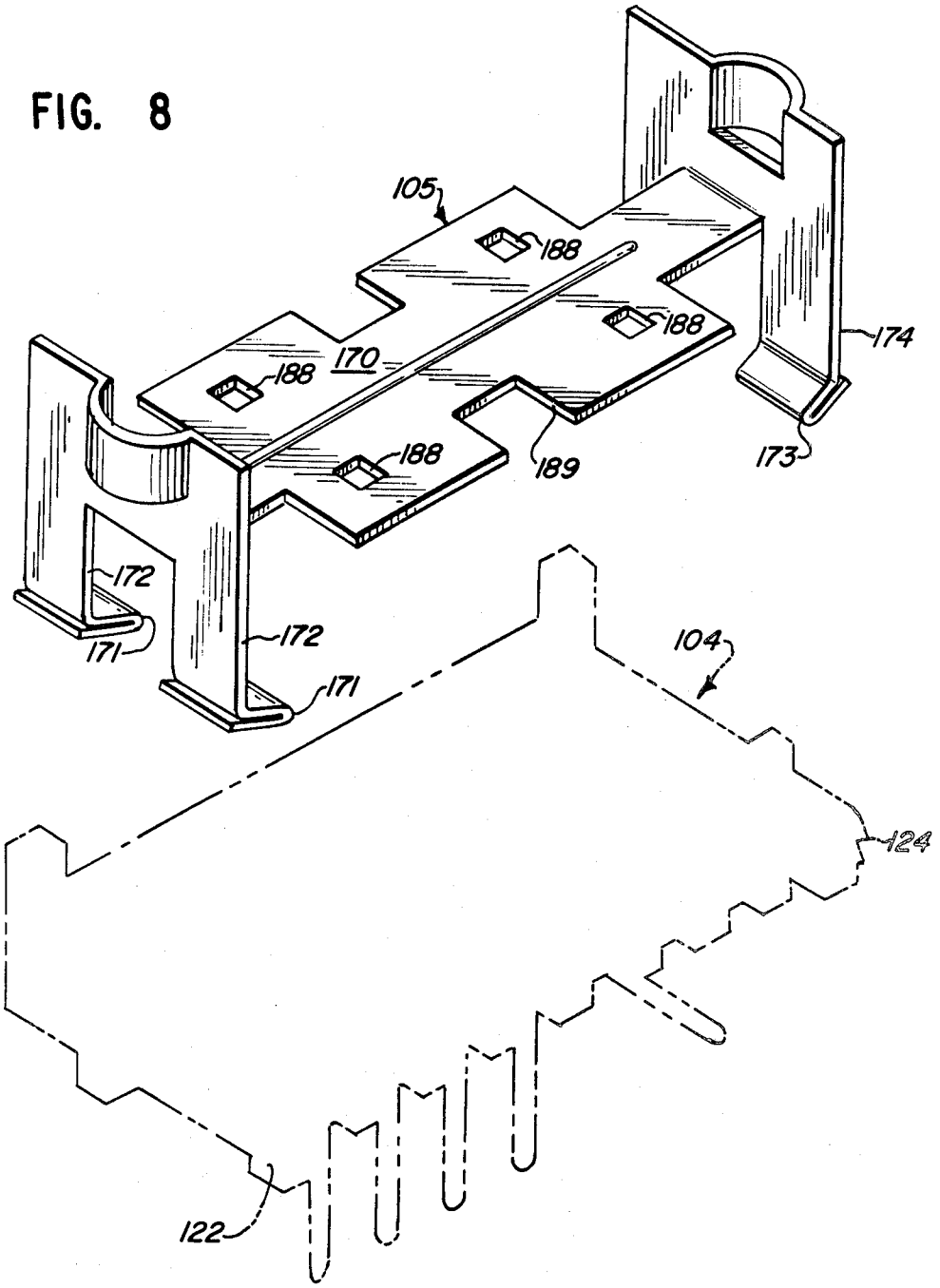
FIG. 8 is a perspective partially exploded view of the connector showing an alternate form of the cover, with the housing and certain contacts shown in phantom lines.

Obviously, many modifications and other embodiments of the subject invention for any number of multiple uses will readily come to one skilled in the art having the benefit of the teachings presented in the foregoing descriptions in accompaniment with the associated drawings. For example, FIG. 8 shows an alternate embodiment of the cover 105. The windows 188 and cover notch 189 function as disclosed earlier herein. The inwardly directed portions 171 and 173 of legs 172 and 174 compressibly engage the cover retaining sides 122 and 124 of the housing 104 for latching with ribs 46 and 48. Said legs also extend above the top 170 to facilitate removal or readjustment of the cover by squeezing them together to relax the compression of the legs against the housing for unlatching from the ribs 46 and/or 48. Depending upon the particular use or environment, such a cover may be preferable to that disclosed in FIG. 1.

Therefore it is to be understood that the invention is not to be limited to the disclosed embodiments and that further modifications and embodiments which will become apparent to those skilled in the art, particularly in the light of the teachings of the present invention, are intended to be included within the scope of the appended claims.

What is claimed is:

1. A connector assembly for electrically connecting a substantially flat flexible first conductor element to a second conductor element, said connector assembly comprising a housing of insulating material defining a first conductor receiving surface for receiving such a first conductor element thereon, and a plurality of contact receiving openings communicating with said first conductor receiving surface;

a plurality of unitary contact means disposed in said openings and each including a resiliently depressable contact portion normally protruding above said first conducting surface for contacting said first conductor element when disposed over said surface; and a terminal portion for conductive engagement with a second conductor element;

a cover in superposed spaced relation to said first conductor receiving surface for receiving said first conductor element therebetween; and means for securing said cover to said housing for pressing such an interposed conductor element against said contact portions to establish and maintain conductive engagement therewith, said cover securing means including a first latch means to selectively maintain said cover in a retracted position superposed said housing for insertion of said conductor element therebetween with near-zero force; and a second latch means to selectively maintain said cover in a position pressing said conductor element against said contact portions.

2. A connector assembly for electrically connecting a substantially flat flexible first conductor element to a second conductor element, said connector assembly comprising a housing of insulating material defining a first conductor receiving surface for receiving such a first conductor element thereon, and a plurality of contact receiving openings communicating with said first conductor receiving surface;

a plurality of unitary contact means disposed in said openings and each including a resiliently depressable contact portion normally protruding above said first conducting surface for contacting said first conductor element when disposed over said surface; and a terminal portion for conductive engagement with a second conductor element;

a first flange means proximate a first segment of said contact means; and a second flange means proximate a second segment of said contact means, one of said flange means being secured in said opening, and the other of said flange means being freely slideable in said opening to permit flexing of said contact means;

a cover in superposed spaced relation to said first conductor receiving surface for receiving said first conductor element therebetween; and means for securing said cover to said housing for pressing such an interposed conductor element against said contact portions to establish and maintain conductive engagement therewith.

3. A connector assembly for electrically connecting a substantially flat flexible first conductor element to a second conductor element, said connector assembly comprising a housing of insulating material defining a first conductor receiving surface for receiving such a first conductor element thereon, and a plurality of contact receiving openings communicating with said first conductor receiving surface;

a plurality of unitary contact means disposed in said openings and each including a resiliently depressable contact portion normally protruding above said first conducting surface for contacting said first conductor element when disposed over said surface; and a terminal portion for conductive engagement with a second conductor element;

a cover in superposed spaced relation to said first conductor receiving surface for receiving said first conductor element therebetween;

means for securing said cover to said housing for pressing such an interposed conductor element against said contact portions to establish and maintain conductive engagement therewith; and strain relief means comprising at least one protrusion of said housing extending above said first conductor receiving surface approximately as high as said flat first conductor is thick, and at least one aperture in said first conductor corresponding with said protrusion and in register therewith, whereby said cover retains said aperture over said protrusion when said cover presses said conductor against said contact portions.

4. A connector assembly as in claim 2 or 3 wherein said first conductor surface is a substantially unobstructed planar surface.

5. A connector assembly as in claim 1 or 2 or 3 wherein said housing includes side guide posts protruding upwardly above said surface.

6. A connector assembly as in claim 1 wherein said side guide posts include a protrusion superposed said first conductor or receiving surface.

7. A connector assembly as in claim 1 wherein said housing includes end guide posts protruding upwardly above said surface.

8. A connector assembly as in claim 1 or 2 or 3 wherein each of said contact receiving openings includes a pair of flange receiving slots extending the length of said opening.

9. A connector assembly as in claim 6 wherein each of said slots includes a retaining shoulder proximate the entrance of said opening.

10. A connector assembly as in claim 1 or 2 or 3 wherein said resilient contacting portion of each of said contact means is bowed.

11. A connector assembly as in claim 1 or 2 or 3 wherein each of said contact means includes a dimple for contacting said first conductor.

12. A connector assembly as in claim 1 or 2 or 3 wherein said terminal portions of said contacts are free of obstructions and may be disposed in a plurality of positions, thereby allowing attachment of said connector to a base in a plurality of positions.

13. A connector assembly as in claim 1 or 2 or 3 wherein said terminal portion of each of said contacts includes a solderless terminal portion.

14. A connector assembly as in claim 1 or 2 or 3 wherein each of said contacts further includes a depending resilient locking tang to engage said housing to prevent removal of said contact.

15. A connector as in claim 1 or 2 or 3 wherein said cover is moveable from said retracted to said pressing position with manual pressure and without the need for specially designed tools.

16. A connector assembly as in claim 1 or 2 or 3 wherein said latch means includes leg attached to said cover to selectively engage said housing.

17. A connector assembly as in claim 1 or 2 or 3 wherein said housing includes at least one locking hook depending from at least one edge thereof to releasably engage an edge of a mounting surface.

18. A connector assembly as in claim 1 including strain relief means comprising at least one protrusion of said housing extending above said first conductor receiving surface approximately as high as said flat first conductor is thick, and at least one aperture in said first conductor corresponding with said protrusion and in register therewith, whereby said cover retains said aperture over said protrusion when said cover presses said conductor against said contact portions.

* * * * *

UNITED STATES PATENT AND TRADEMARK OFFICE

CERTIFICATE OF CORRECTION

PATENT NO. : 4,235,500

DATED : November 25, 1980

INVENTOR(S) : Peter Belopavlovich, Leonard H. Michaels and Richard Zic

It is certified that error appears in the above-identified patent and that said Letters Patent are hereby corrected as shown below:

Column 10, line 24, claim 10, "leg" should be --legs--.

Signed and Sealed this

*Sixteenth* Day of *June 1981*

[SEAL]

*Attest:*

RENE D. TEGTMEYER

*Attesting Officer*

*Acting Commissioner of Patents and Trademarks*